US006821011B1

(12) United States Patent
Crump

(10) Patent No.: US 6,821,011 B1
(45) Date of Patent: Nov. 23, 2004

(54) MIXING SYSTEM CONFIGURED WITH SURFACE MIXING

(76) Inventor: J. Mark Crump, 43 W 145 Campton Hill Dr., Elburn, IL (US) 60119

( * ) Notice: Subject to any disclaimer, the term of this patent is extended or adjusted under 35 U.S.C. 154(b) by 97 days.

(21) Appl. No.: 10/270,097

(22) Filed: Oct. 11, 2002

(51) Int. Cl.[7] ..... B01F 5/10
(52) U.S. Cl. ..... 366/137; 366/173.2
(58) Field of Search ..... 366/136, 137, 366/160.2, 165.1, 165.4, 165.5, 167.1, 173.1, 173.2; 137/563

(56) References Cited

U.S. PATENT DOCUMENTS

| | | | | | |
|---|---|---|---|---|---|
| 626,950 | A | * | 6/1899 | Wheelwright | 366/173.2 |
| 1,991,148 | A | * | 2/1935 | Gephart | 366/167.1 |
| 3,586,294 | A | * | 6/1971 | Strong | 366/163.2 |
| 3,871,272 | A | * | 3/1975 | Melandri | 366/137 |
| 4,332,484 | A | * | 6/1982 | Peters | 366/137 |
| 4,812,045 | A | * | 3/1989 | Rivers | 366/107 |
| 5,458,414 | A | * | 10/1995 | Crump et al. | 366/137 |
| 5,658,076 | A | * | 8/1997 | Crump et al. | 366/270 |
| 5,810,473 | A | * | 9/1998 | Manabe et al. | 366/137 |
| 5,863,119 | A | * | 1/1999 | Yergovich et al. | 366/173.2 |
| 6,065,860 | A | * | 5/2000 | Fuchsbichler | 366/165.5 |
| 6,109,778 | A | * | 8/2000 | Wilmer | 366/173.2 |
| 6,186,657 | B1 | * | 2/2001 | Fuchsbichler | 366/165.5 |
| 6,217,207 | B1 | * | 4/2001 | Streich et al. | 366/137 |
| 2002/0105855 | A1 | * | 8/2002 | Behnke et al. | 366/167.1 |

FOREIGN PATENT DOCUMENTS

| | | | |
|---|---|---|---|
| JP | 55-1802 | * | 1/1980 |

* cited by examiner

*Primary Examiner*—Charles E. Cooley
(74) *Attorney, Agent, or Firm*—Fitch, Even, Tabin & Flannery

(57) ABSTRACT

A system for mixing the solid and liquid contents of a tank using at least one discharge flow generating device causing generally inward and outward flow at or near the surface of the tank contents that meet in a predeterminable region. A surface flow generating device is positioned to direct a fluid stream to break up solid contents present in the region.

20 Claims, 7 Drawing Sheets

MIXING SYSTEM CONFIGURED WITH SURFACE MIXING

FIELD

The apparatus and methods described herein relate generally to tank mixing systems and, in particular, to tank mixing systems for sludge storage tanks and digester tanks requiring surface mixing.

BACKGROUND

Storage tanks are often used for municipal and industrial sludge and other applications, such as storing sludge from municipal and industrial waste treatment facilities. The sludge generally comprises both solid and liquid components. The storage tanks may be used for storing the sludge when received from a waste treatment facility prior to processing and after processing. In addition, storage tanks may be used for treatment processes, such as aerobic and anaerobic digestion. The storage tanks are typically large, ranging from about 10 feet in diameter up to and beyond 150 feet in diameter. The depths of such tanks likewise have a broad range, varying between about 10 feet to about 40 feet and above.

Due to the mixture of liquid and solid components forming the sludge, and the large volumes of sludge frequently present in the tanks, settling of the solid components relative to the liquid components often occurs. The solid components of the sludge tend to settle in a layer toward the bottom of the tank over time, while the liquid contents remain above the accumulated solid layer on the bottom floor of the tank. In order to facilitate removal and/or further processing of the sludge in the tank, including both liquid and solid components, it is desirable to break up the solid layer on the bottom floor of the tank and resuspend the solid components into the liquid components. Such resuspension involves mixing of the tank contents to move the solid components from the floor in order to create a generally homogenous liquid and solid slurry within the tank. A variety of mixing systems aimed at suspending the solid components back into the liquid components of the sludge have been developed. In some instances, flow patterns are developed within the tanks in order to mix the solid and liquid components of the tank contents together in an efficient and effective manner. One such system is disclosed in U.S. Pat. No. 5,458,414.

During the mixing process, gas entrapped in the solid components often causes large chunks of solid debris to rise toward the surface of the tank and even float on the surface of the tank contents, particularly as the solid layer on the tank floor is broken up. Solid debris floating on the surface of the tank in large chunks is undesirable because mixing processes can occur more efficiently beneath the surface of the liquid tank contents. Solid debris on the surface can be difficult to break up and resuspend into the liquid. When flow patterns are developed in the tank contents, it is desirable to have the solid debris submerged for entrapment in the flow pattern to break up the solid debris. Floating solid chunks can reduce digestive capacity and performance, may result in plugged pipes and pumps, and generally inhibit mixing of the tank contents.

Scum layers may also form on the surface of tank contents during the mixing process. Scum layers might appear on the liquid surface of anaerobic digesters and contain grease, vegetables and mineral oils, and other floating materials such as hair, rubber goods, animal fats, bits of cellulose material, pre-fatty acids, and calcium and magnesium soaps.

Scum accumulations can have a specific gravity less than the specific gravity of the sludge, causing the scum to rise toward the surface of the tank contents and even float on the surface.

When the scum accumulations are floating on the surface of the tank contents, it is very difficult to break up or entrap them in the flow pattern beneath the surface of the tank. The scum layers can vary in size from a few inches to several feet in depth. The depth of the scum layer and degree of solidification depends on a variety of factors, such as the volumes of grease and oil in the sludge in the tank, whether sedimentation in the tank is treated separately, the temperature of digester contents, the degree and type of tank mixing, the frequency of cleaning, and whether a tank has a fixed or floating cover. The scum, similar to solid debris floating on the surface, is undesirable because it is difficult for typically submerged tank mixing systems and flow patterns to adequately mix the scum layers and suspend the solid components thereof into the liquid for facilitating removal from the tank or further processing.

In addition to scum, foam can also develop on the liquid surface in anaerobic digesters. Foam can be caused by high grease content, inadequate mixing, a high percentage of activated sludge in food, sludge thickening by dissolved air floatation, several temperature fluctuations, high $CO_2$ content, high alkalinity, low total solids, excessive mixing rates, and high organic content in the food sludge. Foaming is similar to scum except foam typically has entrapped gases that causes the foam, and the contents thereof, to rise to the surface of the tank. Foam, similar to solid chunks and scum, presents a problem for tank storage systems because it is difficult to break up the foam layer and resuspend the solid contents thereof into the liquid solution for facilitating removal from the tank or further processing. A variety of approaches have been developed for attempting to address foam and scum control. For example, when foam and scum is developed due to excessive grease, grease can be removed from the process train using primary clarifiers. However, the use of primary clarifiers in order to remove the grease complicates the tank storage system and increases the cost.

Another solution developed in an attempt to address foam and scum accumulation problems is to continuously mix the contents of the tank to reduce settling of the solid components. However, mixing continuously can be inefficient and can result in even more scum and foam production when excessive mixing rates are used. Rapid mixing can lead to an increase in entrapment of gasses associated with foaming in solid components, resulting in an increase in foam and scum production.

Other complicated methods of attempting to reduce scum and foam involve minimizing temperature fluctuations. However, temperature variations of just two to three degrees Fahrenheit can cause foam problems. Therefore, controlling foaming by reducing temperature variations can be impractical. Scrubbing digester gases to remove $CO_2$ has been done in the past but requires expensive and complicated scrubbing mechanisms. The use of actinomycetes have also be used, but requires time intensive and trial and error experimentation and may not be reproducible due to the large variations in the characteristics in the tank contents frequently present.

In some instances, the use of nozzles positioned above the surface of the tank can be used to break up scum and foam layers present on the surface thereof. Such nozzles require manual operation, such as an operator positioned above the tank on a platform and aiming and directing a fluid stream from the nozzle at the foam and scum deposits on the surface of the tank in a random manner. Typically, the nozzles are rotatably and pivotably mounted allowing an operator to aim the fluid stream as needed at the solid components present on the surface of the tank to break them up and urge them back under water where they can be effectively mixed by the tank mixing system. The nozzles can be problematic due to the requirement of an operator to selectively aim the fluid stream at solid deposits, scum and foam. Not only are the nozzles inefficient due to the increased time and operator effort that must be expended in order to break up the sludge deposits, which can take several hours, but the pumping energy required to pump fluid and discharge fluid through the nozzle can add to the increased cost of operating the tank storage system by substantially disrupting the fluid flow patterns within the tank. Moreover, such nozzles are impractical for use with covered storage tanks, where operator access is often impossible.

SUMMARY

There is provided a new improved method and apparatus for mixing the liquid and solid components of the contents of a tank using a tank mixing system. This is achieved by using a flow generating device positioned to discharge a stream of fluid toward the surface of the tank to break up solid components present at or near the surface in a generally predeterminable region, which provides the improved result of breaking apart or otherwise mixing the solid components present at or near the tank surface for the purpose of facilitating mixing of the tank contents.

The tank may be generally circular in shape having an outer surrounding wall with a radius extending from the center of the tank to the outer surrounding wall. The tank is at least partially filled with contents having both solid and liquid components to a liquid level having a surface. A sump may be provided for withdrawing at least some of the contents from the tank. A pump may be provided having its input connected to the sump for withdrawing at least some of the contents of the tank through the sump. At least one submerged flow generating device, such as a nozzle or a propeller, is positioned within the tank and operatively connected to a discharge of the pump for pumping some of the contents through the submerged flow generating device to rotate the tank contents in a generally circumferential direction. An upper flow generating device, such as nozzle, may be positioned at an elevation above the liquid level of the tank contents and aimed to selectively discharge at least some of the contents into the tank at a downward angle relative to the surface of the liquid contents and tangent to a generally circular band on the surface between the tank outer surrounding wall and the center of the tank.

According to one aspect, the location of the generally circular band is between about 2% and about 50% of the tank radius inward from, the tank outer surrounding wall. The characteristics of the pump discharging fluid from the flow generating device and the diameter of the tank in part results in an energy gradient within the tank. The location of the generally circular band may be in part dependent upon the energy gradient within the tank. For example, when the energy gradient is below 80 horsepower per million gallons the location of the generally circular band may be between about 2% and 20% of the tank radius inward from the outer surrounding wall of the tank. When the energy gradient within the tank is above 80 horsepower per million gallons the location of the generally circular band may be between about 20% and about 50% of the tank radius inward from the outer surrounding wall of the tank.

The upper flow generating device may be elevated above the surface of the tank contents, and may be elevated about 10 feet above the surface of the tank contents. The upper flow generating device may be attached relative to the tank outer surrounding wall or, if the tank has a roof, to the roof of the tank. A platform may be provided for the upper flow generating device to be mounted on. The upper flow generating device may also be mounted on a preexisting platform, particularly when retrofitting existing tanks already having elevated platforms with the mixing system in accordance herewith.

The upper flow generating device is operatively connected to a pump that withdraws at least some of the contents from the tank for discharge through the upper flow generating device. The pump may be the same pump for the submerged nozzles. The discharge rate of fluid through the upper flow generating device may be dependent in part upon the energy gradient within the tank. The upper flow generating device may have a discharge rate of between about 100 gallons per minute and about 500 gallons per minute. The tank contents may have a volume and the discharge rate of the upper flow generating device may be selected to be between about 1/10 of a percent and 1/30 of a percent of the contents volume.

Another system is provided from mixing the liquid and solid contents of a tank. The system includes an outer surrounding wall of the tank for at least partially containing the solid and liquid components therein. At least one flow generating flow generating device, such as a nozzle, propellor, or other suitable apparatus, is positioned to discharge fluid into the tank for creating a fluid flow within the tank. The fluid flow has a flow moving the contents of the tank in a direction of rotation in addition to having a generally inward component and a generally outward component proximate the surface of the tank contents. The generally inward and generally outward components of the fluid flow meet in a region of the tank. A surface flow generating device, such as a nozzle or other suitable apparatus, is oriented above the tank contents to downwardly direct a fluid stream onto the surface of the tank contents at the region of the tank where the generally inward and outward components of the fluid flow meet.

The tank may be generally circular and thus the outer surrounding wall may also be generally circular and located at a radial position from the center of the tank. The surface of the tank contents extend to a height above the floor of the tank.

The flow generating device may be submerged beneath the surface of the tank contents and the surface flow generating device may be positioned a distance spaced above the surface of the tank contents. A pump having a pumping rate may be operatively connected between the tank and the flow generating device for drawing at least some of the contents from the tank and discharging them through the flow generating device to create the fluid flow.

The region of the tank where the generally inward and generally outward components of the fluid flow meet may be a generally circular band positioned between the outer wall and a center of the tank at a predeterminable location. The location of the generally circular band may be determined based in part upon the pump rate, the viscosity of the tank contents, the tank radius, and the height of the contents within the tank. When a portion of the solid contents are present on a surface of the tank contents within the generally circular band, the surface flow generating device is positioned to discharge the fluid stream to contact the portion of the solid contents. The contact between the fluid stream and the portion of the solid contents may break up the portion of the solid contents for submergence beneath the surface of the tank contents and for entrapment into the fluid flow within the tank. The fluid stream of the surface flow generating device may be positioned at an angle relative to a radial line extending from the tank center to the tank outer wall. In addition, the surface flow generating device fluid stream may be directed in the direction of rotation of the tank contents to minimize disruptions in the fluid flow.

The fluid flow may include the flows described in U.S. Pat. No. 5,458,414, the disclosure of which is hereby incorporated by reference in its entirety. The fluid flow may include a flow toward the outer portion of the tank in the lower portion of the tank, upward in the outer portion of the tank, inward in the upper portion of the tank, and downward in the inner portion of the tank. These flows may be repeated as the contents flow in the rotational flow pattern.

A method is also provided for mixing the liquid and solid contents of a tank having a outer surrounding wall. The method includes discharging a stream of fluid into the tank through one or more discharge nozzles. The method also includes creating a fluid flow within the tank using the fluid discharged through the one or more submerged nozzles at a fluid discharge rate. The fluid flow has a generally inward component and generally outward component present near a surface of the tank contents. The generally inward and generally outward components of the fluid flow meet in a region of the tank. The method further includes directing a fluid flow from a surface nozzle onto the surface at the region of the tank where the generally inward and generally outward components of the fluid flow meet. In a further aspect of the method, the method includes determining the location of the region of the tank where the generally inward and outward components of the fluid flow meet based upon the tank size, the contents, characteristics and the fluid discharge rate. The step of creating a fluid flow may also include inducing a rotational flow of the tank contents with the one or more discharge nozzles. The step of directing a fluid flow may also include aiming the surface nozzle in the direction of rotation of the tank contents.

DETAILED DESCRIPTION OF THE DRAWINGS

Figure 1:
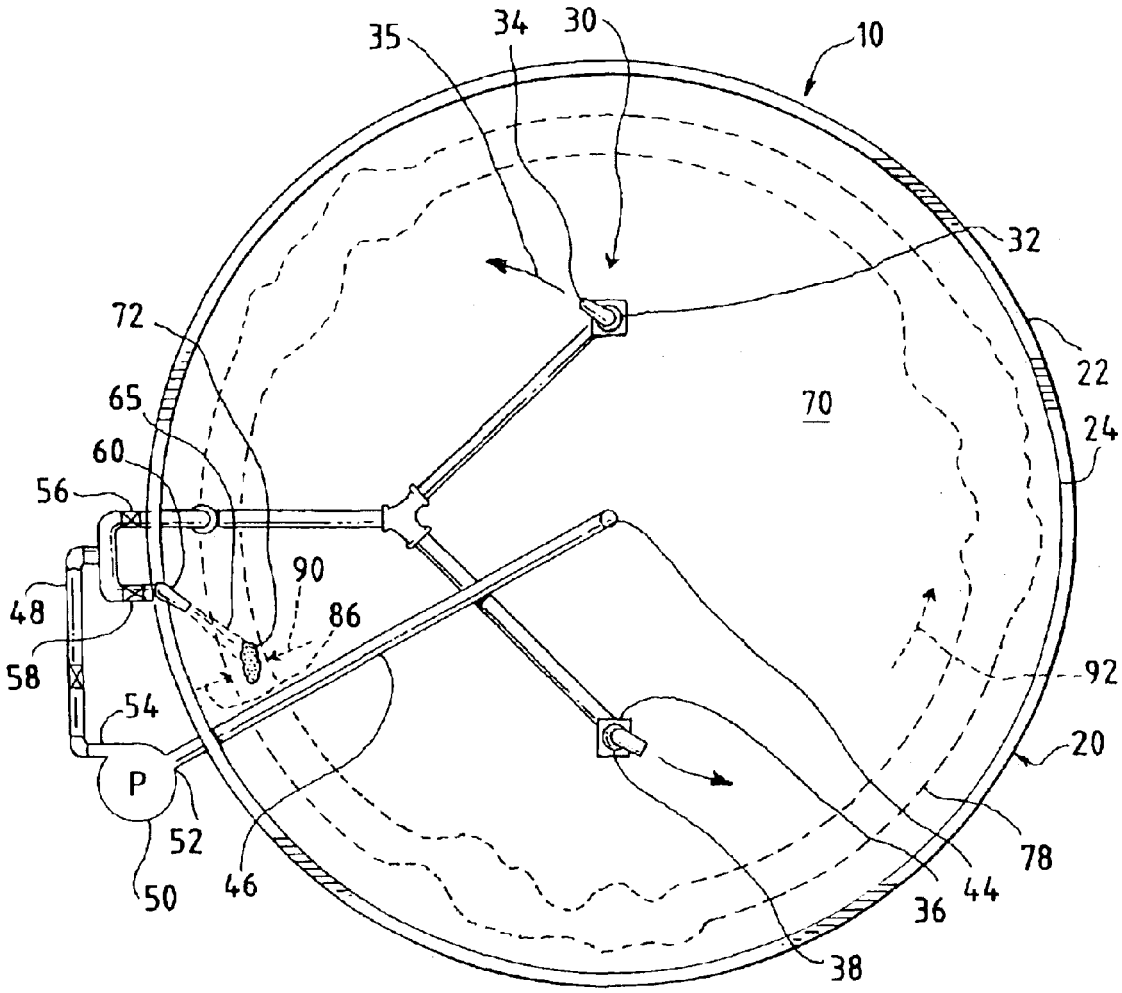
FIG. 1 is a top plan view of a mixing system including an aerobic tank, submerged nozzles positioned about the floor of the tank, and a surface nozzle.

As shown in the drawings for purposes of illustration, there are illustrated embodiments of tank mixing systems in FIGS. 1–4. The mixing systems 10 shown are for mixing solid and liquid components 74 and 76 of contents 70 within a tank 20. Multiple mixing nozzles 30 are positioned on floors 24 of the tanks 20 through which streams of fluid 35 are discharged into the tank contents 70. The mixing nozzles 30 are positioned to generate one or more flow patterns within the tank 20 for mixing the solid and liquid components 74 and 76 of the tank contents 70. The flow patterns may cause solid debris 72, such as solids, scum accumulations, and foam, to be positioned on or near the surface of the tank contents 70 within a generally predeterminable generally circular band 78. In order to mix the solid debris 72, an upper nozzle 60 is prepositionable above the surface of the tank contents 70 for directing a stream of fluid 65 within the generally circular band 78 to contact the solid debris 72.

One or more mixing nozzles 30 are positioned within the tank 20, as illustrated in FIGS. 1–4. The mixing nozzles 30 each include a base 36 for securement to the tank floor 24. Attached relative to the base 36 is a discharge nozzle 32, comprising an elbow shaped pipe having a nozzle outlet 34 at one end through which fluid is discharged into the tank 20. The base 36 also may operatively connect the discharge nozzles 36 to piping 42 for supplying fluid. The base 36 may include an elbow shaped pipe, or may include a mounting frame and/or footing. Although the mixing nozzles 30 are illustrated and preferably are positioned on the tank floor 24, other ways of positioning the nozzles 30 are equally suitable. For example, the nozzles 30 may be suspended from above the tank floor 24.

In order to provide fluid for discharge through the mixing nozzles 30, a sump 44 inside the tank 20 is in communication with the mixing nozzles 30. One or more pumps 50 are positioned outside of the tank outer surrounding wall 22 to draw fluid contents 70 from within the tank 20 via the sump 44. The sump 44 is positioned on the floor 24 of the tank 20, and can be located either above the tank floor 24 or within the tank floor 24. Piping 46 extends between the sump 44 and an inlet 52 of the pump 50 for drawing fluid 70 from the tank 20 through the sump 44. The outlet 54 of the pump 50 is operatively connected to the mixing nozzles 30 by piping 42 and 48 for discharging fluid 70 therethrough. One or more valves 56 may be positioned along the piping 48 to control the flow of fluid from the pump outlet 54 to the nozzle piping 42 and mixing nozzles 30.

The pump 50 is preferably of the chopper type, whereby solid components 74 of the solid and liquid components 74 and 76 of the tank contents 70 are withdrawn from within the tank 20 through the sump 44 and agitated to break up the solid components 74 for suspension in the liquid components 76. The pump 50 may have a plurality of vanes through which the contents are drawn that break the solid components 74 into smaller solid components. A preferred type of chopper pump is manufactured by Hayward-Gordon Ltd., 6660 Campobello Road, Mississauga, Ontario, Canada. Another type of chopper pump is manufactured by Vaughan Company, Inc., 364 Monte-Alma Road, Montesano, Wash.

Figure 2:
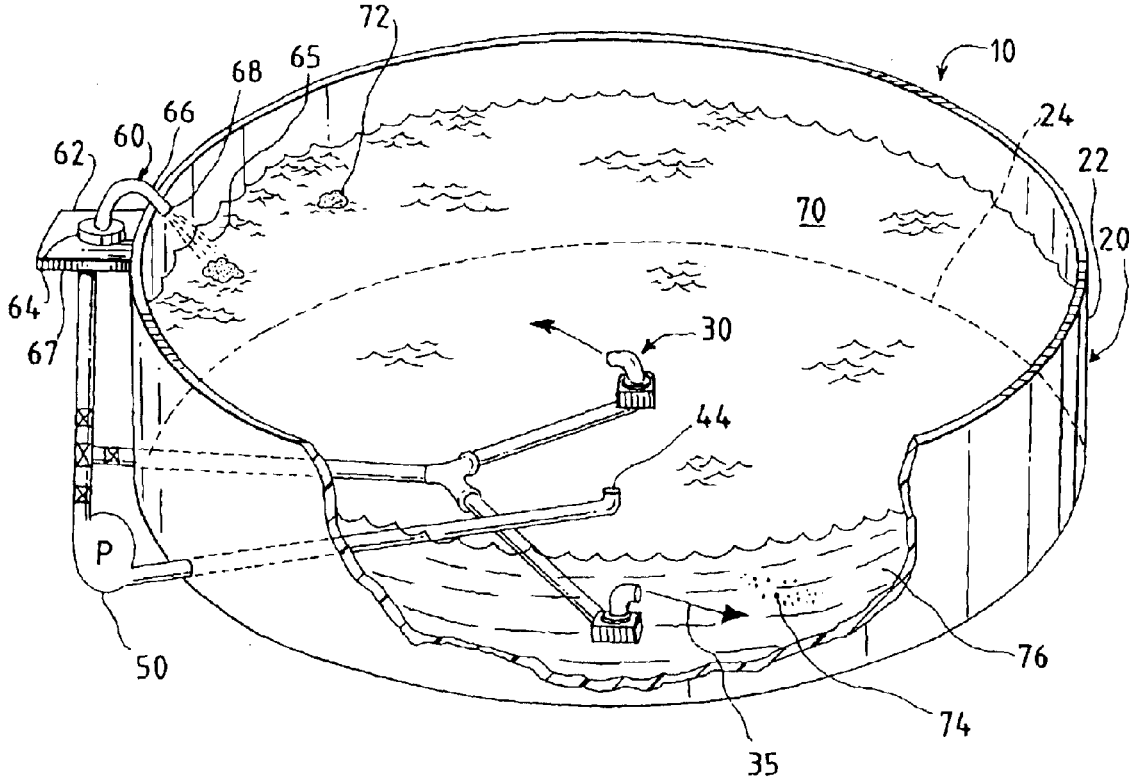
FIG. 2 is a perspective view of the mixing system of FIG. 1 with a portion of the tank broken away to show the interior thereof with the surface nozzle directing a stream of fluid toward floating debris.

The number of mixing nozzles 30 within the tank 20 is selected based upon the size of the tank 20 and the characteristics of the contents 70 of the tank 20 to be mixed. For instance, a larger tank 20 may have more mixing nozzles 30 than a smaller tank 20. As diagrammatically illustrated in the tank mixing system 10 of FIGS. 1 and 2, two mixing nozzles 30 are positioned on the floor 24 of the tank 20. The tank mixing system 10 diagrammatically illustrated in FIGS. 3 and 4, having a larger tank 20 than the tank 20 illustrated in FIGS. 1 and 2, depicts six mixing nozzles 30 positioned on the floor 24 of the tank 20.

Figure 3:
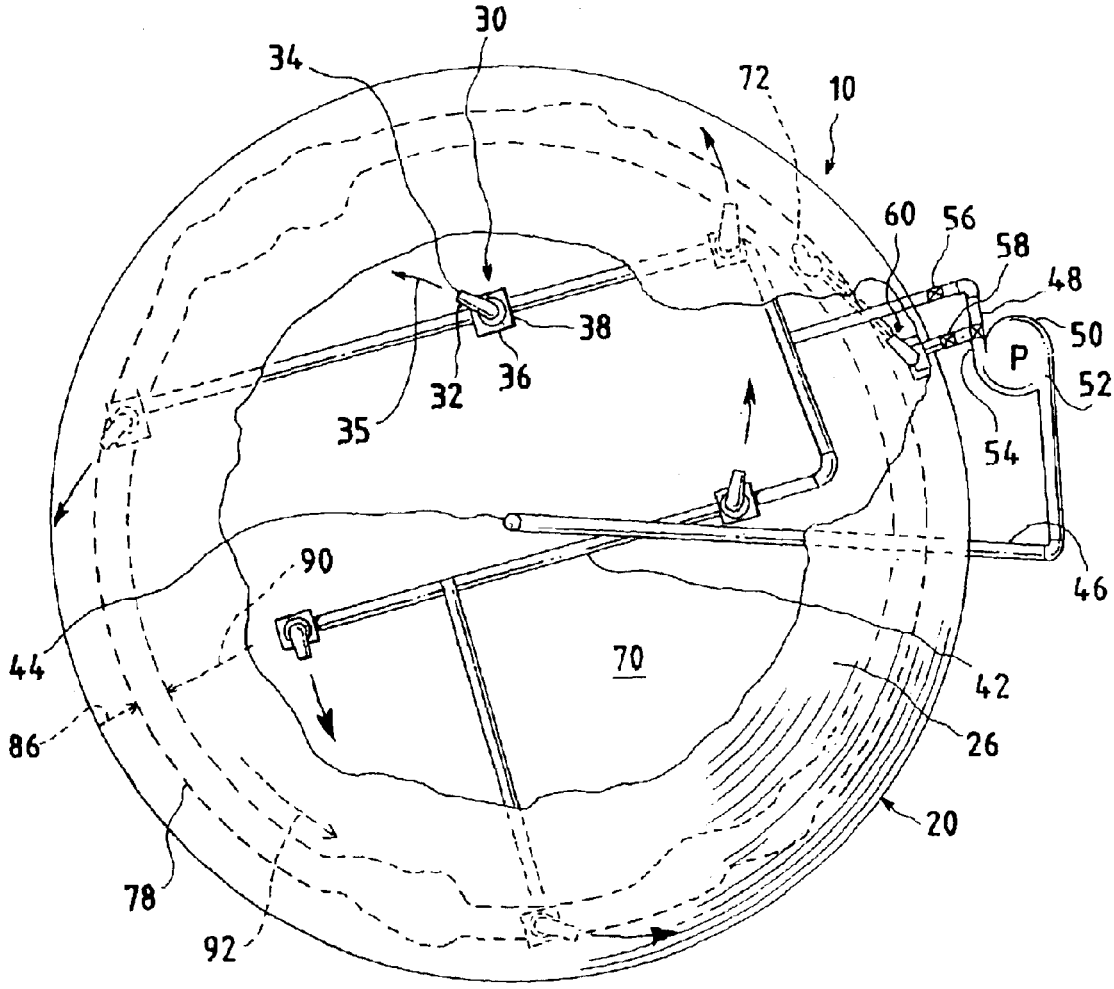
FIG. 3 is a top plan view of another tank mixing system including an anaerobic tank having a cover partially broken away, submerged nozzles positioned about the floor of the tank, and a surface nozzle.
Figure 4:
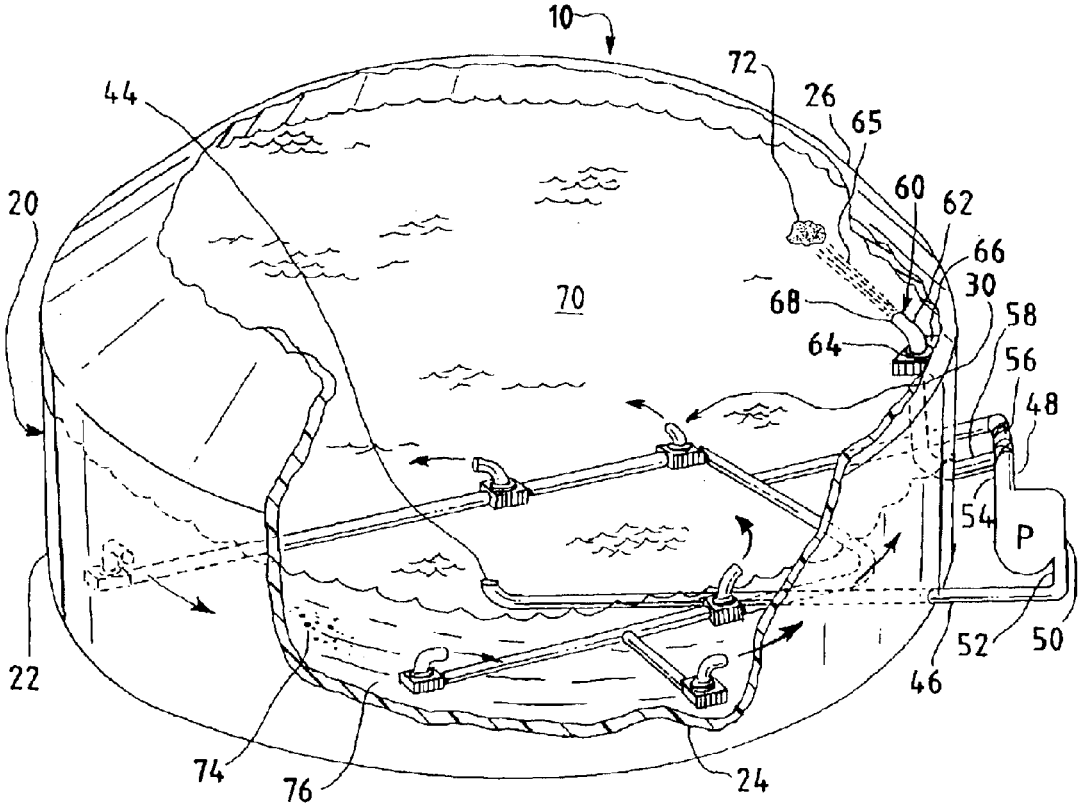
FIG. 4 is a perspective view of the mixing system of FIG. 4 with portions of the tank and cover broken away to show the interior thereof and the surface nozzle directing a stream of fluid toward floating debris.

The tank 20 of FIGS. 3 and 4 has a cover or roof 26. The roof 26 may be used to retain gases generated by the tank contents 70, such as in the case of an anaerobic digester system. The roof 26 may be slidably attached to the tank 20 so that the roof 26 can move upward and downward as necessary, such as dependent upon the volume of the tank contents 70 and the gases developed thereby.

During operation of the tank mixing system 10, when the pump 50 is withdrawing the tank contents 70 through the sump 44 and discharging the tank contents 70 through the mixing nozzles 30, one or more flow patterns 80 and 92 may develop. The flow patterns 80 and 92 may assist in moving the contents 70 of the tank in order to suspend the solid components 74 in the liquid components 76 of the tank contents 70. The flow patterns 80 and 92 may be partly or completely random, or may be a general pattern having approximately repeating portions along with random fluid flows.

When substantial amounts of solid components 74 are present in a tank 20, such as when the tank 20 has not been mixed for a substantial period of time, large debris pieces 72 of the solid components 74 can rise to the surface of the tank 20 due to agitation with the discharge stream 35 from the mixing nozzles 30. Some of these solid debris pieces 72 may float at or near the surface of the tank contents 70 within a ring around the tank 20. It has been found that the flow patterns 80 and 92 or movement of the contents within the tank 20 can cause the radial location of the floating solid debris pieces 72 to be generally predeterminable based upon a variety of factors.

The surface or upper nozzle 60 is positioned above the surface of the tank contents 70 for directing a stream of fluid 65 onto the surface of the tank contents 70. The fluid stream 65 of the surface nozzle 60 is aimed toward the generally circular band 78 in order to break up any solid debris pieces 72 that are rotating around the tank 20 in the prescribed generally circular band 78 as they pass through the fluid stream 65. In order to not disrupt the rotational flow 92 and fluid flow patterns 80 of the fluid contents 70 within the tank 20, it is preferred that the fluid stream 65 be directed in an angle generally tangent to the proscribed generally circular band 78 and in the direction of rotation 92 of the tank contents 70.

The flow rate of the fluid stream 65 directed through the surface nozzle 60 is carefully selected to be sufficient to break up the solid debris pieces 72 on the surface of the tank contents 70 while being not so large so as to significantly impede the mixing of the tank 20 or to substantially disrupt the fluid flow patterns 80 and 92. The discharge rate may be dependent in part upon the energy gradient within the tank 20 and the tank diameter. In a preferred embodiment, the surface nozzle 60 discharges fluid 65 at a rate of between about 100 gallons per minute and 500 gallons per minute. The discharge rate may also be selected dependent upon the tank volume, and preferably can be selected to between about 1/10 of a percent and 1/30 of a percent of the volume of tank contents 70.

The surface nozzle 60 is similar to the mixing nozzles 30, having a discharge nozzle 62 mounted to a base 66. The base 66 is mounted relative to the tank 20, such as on a platform 67 attached to the tank 20 and at an elevation above the surface of the tank contents 70 or directly to the tank outer surrounding wall 22. The elevation of the upper nozzle 60 is selected based in part upon the position of the generally circular band 78 and the flow rate of the fluid stream 65 exiting the discharge nozzle 62 in order to both direct the stream 65 into the generally circular band 78 and to minimize disruptions in the flow patterns. In the preferred embodiment of the mixing system 10, the upper nozzle 60 is preferably elevated at least five feet above the surface of the tank contents 70, and preferably about ten feet above the surface of the tank contents 70, although other elevations may be suitable depending on the mixing system parameters. The angle of the fluid stream 65 is also selected based in part upon the position of the generally circular band 78 and the flow rate of the fluid stream 65 exiting the discharge nozzle 62 for directing the stream 65 into the generally circular band 78 while minimizing disruptions in the flow patterns. In a preferred embodiment of the mixing system 10, the discharge nozzle 62 is angled downward at an angle between about ten degrees and fifty degrees relative to the surface of the tank contents 70, although other angles may be suitable depending upon the mixing system parameters. The base 62 is connected via piping 48 to the pump outlet 54. A valve 58 is positioned between the outlet 54 of the pump 50 and the surface nozzle 60 to enable selective operation of the surface nozzle 60. For example, it has been found that floating solid contents 72 tend to be more prevalent two to four hours after a mixing system 10 has began operation. In such a case, a timer can control the valve 58 to allow for operation of the surface nozzle 60 to break up the solid debris 72.

Figure 5:
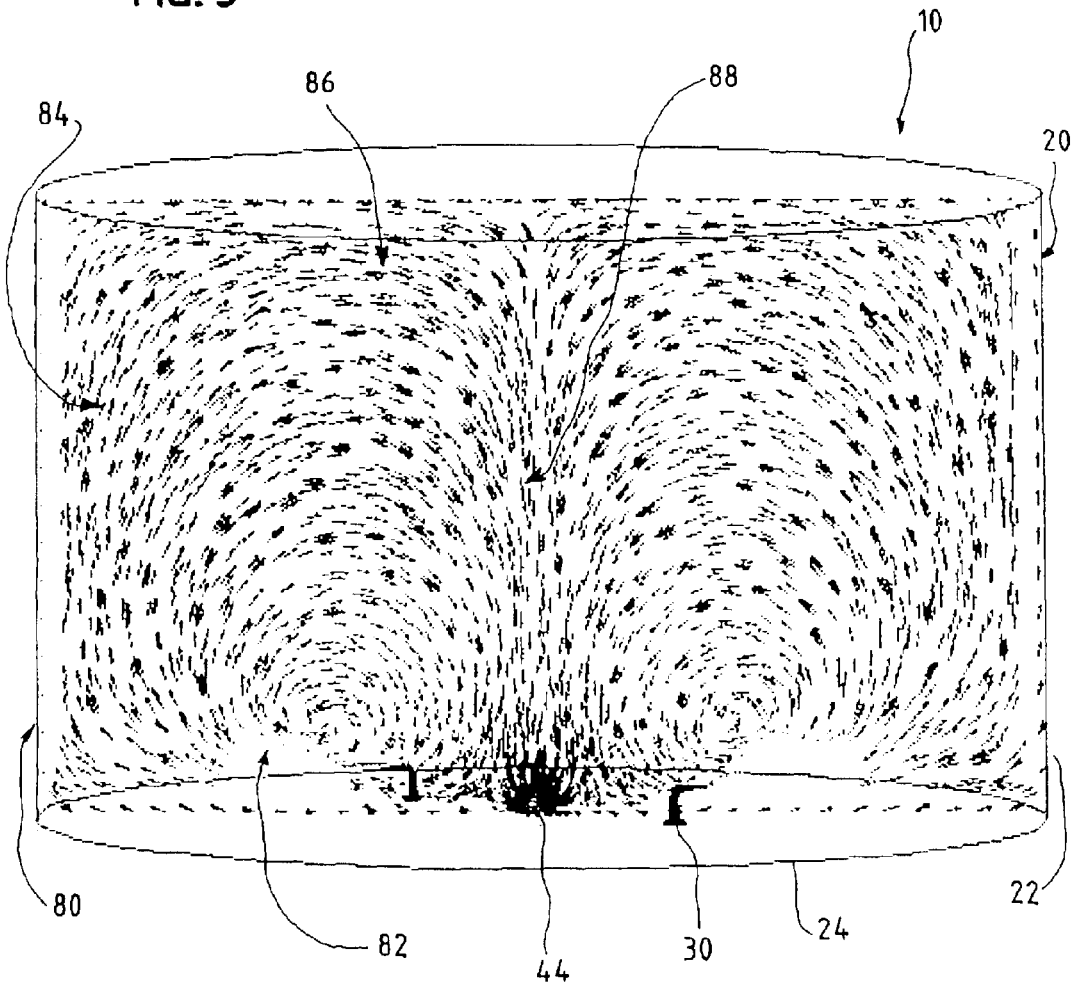
FIG. 5 is a vertical section depiction of flows in the form of velocity vectors capable of being formed with a tank mixing system similar to the tank mixing system of FIG. 1.

In a preferred embodiment of the tank mixing system 10, the mixing nozzles 30 are positioned and oriented to create a fluid pattern 80 that includes flow paths 82 toward the outer surrounding wall 22 in the lower portion of the tank 20, flow paths 84 upward in the outer portion of the tank 20, flow paths 86 inward in the upper portion of the tank 20, and flow paths 88 downward in the inner portion of the tank 20, as discussed in greater detail hereinbelow. One example of such is illustrated in FIG. 5. In addition to the fluid pattern 80, the mixing nozzles are also positioned to generate a rotating fluid pattern 92. When the rotating pattern 92 and fluid pattern 80 are combined, the fluid pattern 80 may be present one or more times throughout the rotational flow pattern 92 in the tank contents 70.

The fluid pattern 80 is selected to at least partially counteract the fluid phenomena known as the tea-cup effect. During rotation of a body of fluid in a tank where the tea-cup effect is present, fluid flows tend to be upward in the inner portion of the tank, outward in the upper portion of the tank, downward in the outer portion of the tank, and inward in the lower portion of the tank. Due to the flow of fluid inward in the lower portion of the tank, solids may tend to accumulate in the center portion of the tank along the floor. When attempting to mix the contents of tank, it is desirable to move accumulated solids away from the center portion of the tank floor and suspend the solid components in the liquid components of the tank contents. Thus, in a preferred tank mixing system 10, the outward fluid flows 82 in the lower portion of the tank 20, such as depicted in FIG. 5, tend to counteract the tea-cup effect.

The inward flow of fluid in the fluid paths 86 in the upper portion of the tank 70 causes some or all of the solid debris pieces 72 (as opposed to solid particles) to be directed toward the center portion of the tank 20. However, a competing fluid flow due 90 to the circumferential forces generated by the rotational flow 92 of the tank contents 70 causes the solid debris pieces 72 to be directed toward the outward surrounding wall 22. The balance of these forces generally proximate to or at the surface of the tank 20 affects the radial position of the solid debris 72. Due to the counteracting surface flows 86 and 90, the solid debris pieces 72 tend to rotate around the tank 20 within a generally predeterminable generally circular band 78.

The approximate position of the generally circular band 78 can be predetermined based upon the energy gradient within the tank 20 and the tank diameter. The energy gradient within the tank 20 is determined based upon the volume of the tank contents 70 and the amount of pumping power input into the tank 20. The energy gradient can be expressed in terms of horsepower per million gallons as follows:

$$E_{gradient}=\text{horsepower}/1{,}000{,}000 \quad (1)$$

For circular tanks, this equation can be expressed in terms of the total volume of the tank contents 70 as follows:

$$E_{gradient}=\text{horsepower}/(\text{volume}/1{,}000{,}000) \quad (2)$$

Thus, for circular tanks lacking a conical bottom, the equation can be expressed as follows:

$$E_{gradient}=\text{horsepower}/(gr^2\pi h_T/1{,}000{,}000) \quad (3)$$

where r is the tank radius, $h_T$ is the tank height, and g is a conversion factor between cubic feet and gallons. For circular tanks having a conical bottom, the equation can be expressed as follows:

$$E_{gradient}=\text{horsepower}/((r^2\pi h_T+1/3\pi r^2 h_c)g/1{,}000{,}000 \quad (4)$$

where r is the tank radius, $h_T$ is the tank height, $h_C$ is the cone depth, and g is a conversion factor between cubic feet and gallons.

As set forth in the below table, the approximate position of the generally circular band 78 inward from the outer surrounding wall 22 of the a tank 20, having flow patterns 80 and 92 as discussed above, is dependent in part upon the energy gradient in the tank 20 and the tank diameter:

| Tank Diameter | Energy Gradient | Circular Band Location |
|---|---|---|
| 30 feet | 50 HP/MG | 5–7 feet |
| 30 feet | 90 HP/MG | 6–8 feet |
| 30 feet | 120 HP/MG | 7–9 feet |
| 100 feet | 50 HP/MG | 8–10 feet |
| 100 feet | 90 HP/MG | 10–12 feet |
| 100 feet | 120 HP/MG | 14–16 feet |
| 200 feet | 50 HP/MG | 9–11 feet |
| 200 feet | 90 HP/MG | 12–14 feet |
| 200 feet | 120 HP/MG | 19–21 feet |

Figure 6:
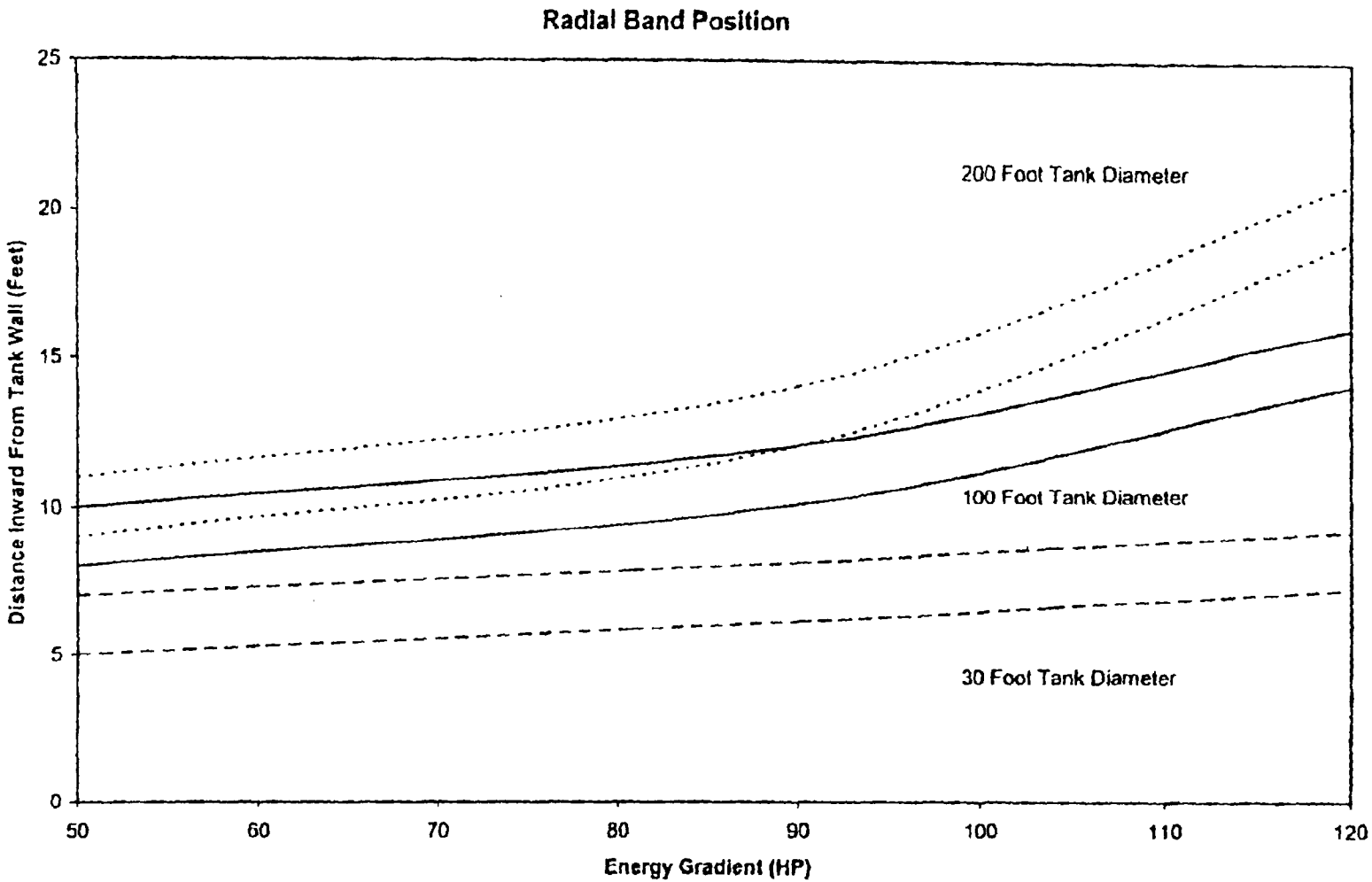
FIG. 6 is a chart depicting predicted positions of generally circular bands from outer tank walls where inward and outward surface flows may meet.

The generally circular band 78 positions in the above table are illustrated in the chart of FIG. 6 comparing the energy gradient and the tank diameter to the generally predeterminable distance of the generally circular band 78 inward from the outer surrounding wall 22 of the tank 22. Although the generally circular band 78 is described as being about two feet wide, it may be larger or smaller depending upon the parameters of the tank mixing system 10. For example, as the tank diameter becomes larger the width of the generally circular band 78 may increase. In addition, the generally circular band 78 may have substantial variances in its shape and size. For example, the band 78 may be more diamond-shaped in a square or rectangular tank.

From the foregoing it will be appreciated that the problem of mixing solid content present on or near the surface of the tank contents 74, including solid debris, scum accumulations, and foam, has been overcome by prepositioning an upper nozzle 60 to discharge a stream of fluid 65 into a predeterminable generally circular band 78 where the solid content 74 proximate the surface likely will be present to break apart or otherwise facilitate mixing thereof.

Turning to more of the details of the tanks 20, each of the tank mixing systems 10 include a generally circular tank 20 having an upstanding, outer surrounding wall 22 extending upward around the circumference of the tank 20 from a tank floor 24. The tank 20 may be located above ground, or may be partially or completely disposed below ground level. The outer surrounding wall 22 is preferably formed of a plurality of metal tank sections secured together, although other materials and methods may be used for forming the tank outer surrounding wall, such as concrete or fiberglass. The tank floor 24 is preferably formed of concrete, although other suitable floor materials may be used. The floor 24 of the tank 20 may be generally planar, or alternatively may include a conical region sloping downward to the center of the tank 20.

In a preferred embodiment, the base 36 of the mixing nozzles 30 may be adapted to allow for selective rotation of the discharge nozzles 32 with a rotation mechanism 38. Rotatable discharge nozzles 32 can advantageously facilitate periodic removal of solid deposits in localized areas of the tank floor 24. Selective rotation preferably can be accomplished remote from inside the tank 20. For example, manually cranks may be positioned on the outside of the tank 20, such as proximate the tank outer surrounding wall 22. The cranks can be operatively connected to the rotation mechanism 38 of the base 36 via a linkage, whereby rotation of the cranks causes the linkage to rotate the rotation mechanism 38 of the base 36 and thus the discharge nozzle 32. The rotation mechanism 38 may include a set of gears with a gearing ratio selected to facilitate rotation of the discharge nozzle 32, such as by manually turning the crank or a wheel positioned outside of the tank 10. A motor remotely operable from outside the tank may also be used to activate the rotation mechanism 38 and rotate the discharge nozzle 32.

Turning now to more of the details of the flow patterns 80 and 92, a preferred type of flow pattern 80 is illustrated in FIG. 5. The flow pattern 80 of FIG. 3 may be combined with a rotational flow pattern 92 to mix the contents 70 of the tank 20. FIG. 5 depicts velocity vectors in a horizontal plane passing through the center of the tank 20 to indicate flow direction and magnitude. The position and orientation of the velocity vectors were determined using computational fluid dynamics computer software to simulate the flow conditions in a tank 20. The tank 20 was modeled using CFX-5 by AEA Technology Engineering Software, Inc., Omega Corporate Center, 1260 Omega Drive, Pittsburgh, Pa. The boundary conditions were set to approximate the actual conditions in a tank mixing system 10.

As seen in FIG. 5, the flow patterns in the tank 20 are depicted as velocity vectors in a vertical plan passing through the center of a tank 20 of a tank mixing system having two mixing nozzles 30 positioned on the floor 24 of the tank 20. The fluid is discharged at a relatively high flow rate through the mixing nozzles 30 which are directed at an angle to the radius to generate flows with tangential components of flow to impart a rotational movement 92 of the tank contents 70. By aiming the mixing nozzles 30 at an angle other than normal to the outer surrounding wall 22, the rotational fluid flow component 92 can be developed. As can be seen in the lower portion of the tank 20, there is a fluid flow not just from the nozzles 30, but also from the center of the tank 20 outward toward the outward surrounding wall 22 that also is part of the lower fluid flow path 82. Some of the flow from the center of the tank 20 is due to entrapment of fluid in the streams discharged from the mixing nozzles 30. The discharge nozzles 32 preferably are slightly angled downward to ensure that solid components 74 of the tank contents 70 disposed on or close to the floor 24 are agitated and suspended into the liquid components 76 of the tank contents 70.

When the fluid flow is in the outer portion of the tank 20, the outer surrounding wall 22 has the effect of causing some of the fluid in the flow path 84 to travel upward toward the upper portion of the tank 20. The angle at which the fluid is discharged from the mixing nozzles relative to normal to the tank wall 22 determines in part the particular characteristics of the generally upward flow path 84. For example, a lesser angle between the fluid discharge 32 and a line normal to the outer surrounding wall 22 can result in the fluid flow path 84 turning upward close to the outer surrounding wall 22. Conversely, a larger angle between the fluid discharge 32 and a line normal to the outer surrounding wall 22 can result in the fluid flow path 84 gradually moving upward between the mixing nozzles 30 and the outer surrounding wall 22.

In the upper portion of the tank 20 fluid travels in a flow path 86 from the outer portion of the tank 20 to the inner portion of the tank 20. Some of the fluid may be traveling close to the surface of the tank contents 70, and can create visible indications of the fluid flow on the surface of the tank contents 70. Depending in part upon the momentum of the solid and liquid components 74 and 76 in the generally upward flow path 84 in the outer portion of the tank 20, the flow paths 86 inward in the upper portion of the tank 20 may be partially horizontal or may be downward from the outer portion of the tank 20 toward the inner portion of the tank 20. For example, if the momentum of the components 74 and 76 is larger, then the flow paths 86 may be partially horizontal. If the momentum of the components 74 and 76 is lower, then the path 86 may be inclined downward from the outer portion of the tank 20 toward the inner portion of the tank 20.

In the inner portion of the tank 20, the flow paths 88 generally travel downward from the upper portion of the tank 20 to the lower portion of the tank 20. The downward flow paths 88 are due in part to gravity and the suction through the sump 44 caused by the pump 50. From the lower portion of the inner portion of the tank 20, some fluid is withdrawn from the tank 22 through the sump 44.

Thus, as evident in FIG. 5, generalized flow paths 82, 84, 86, and 88 extend toward the outer surrounding wall in the lower portion of the tank 20, upward in the outer portion of the tank 20, inward in the upper portion of the tank 20, and downward in the inner portion of the tank 20. The flow paths 82, 84, 86, and 88 of the flow pattern 80 may repeat one or more times during rotation of the tank contents due to the rotational flow pattern 92 to mix the tank contents 70.

Several factors related to the mixing nozzles 30 determine the extent and magnitude to which the flow patterns 80 and 92 are developed and thus the position of the generally circular band 78. For instance, the diameter of the nozzle opening 34, the angle of the nozzle discharge 32 relative to the tank outer surrounding wall 22, the number of nozzles 30, the radial position of the nozzles 30, the angle of the nozzle discharge 32 relative to the tank floor 24, and the elevation of the nozzles 30 from the tank floor 24 can effect the flow patterns 60 and 92 within the tank 20. For example, it has been found that preferred flow patterns 80 and 92 are developed when the mixing nozzles 30 are positioned within a radial band extending between about 25% and 75% of the radius of the tank 20, and more preferably within a radial band between about 30% and 70% of the radius of the tank 20.

Figure 7:
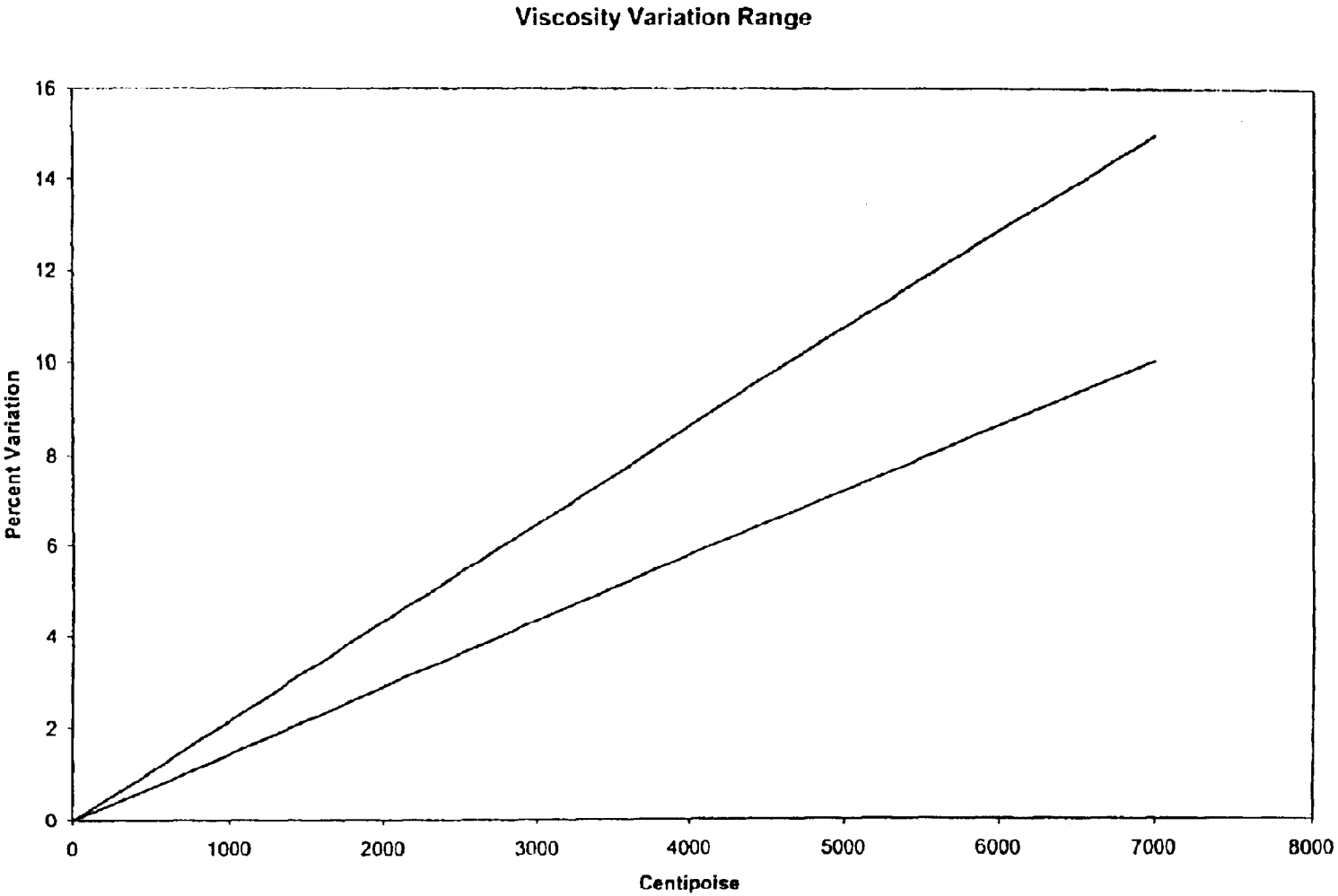
FIG. 7 is a chart depicting variations in the positions of the generally circular bands from outer tank walls depending in part upon the viscosity of fluid in the tank.

Other factors that determine the extent and magnitude to which the flow patterns 80 and 92 are developed, and thus the position of the generally circular band 78, include the tank diameter, the energy gradient within the tank 20, the characteristics of the tank contents 70, and the flow rate of the fluid 35 being discharged through the nozzles 30. For instance, the viscosity of the tank contents 70 can result in a variation in the position and extent of the generally circular band 78. As illustrated in the chart of FIG. 7, the variation, depicted as a percentage in the location of the generally circular band 78, can vary up to about fifteen percent when the viscosity of the tank contents 70 increases to about 7,000 centipoise. Thus, the extent and location of the generally circular band 78 can be determined in part based upon a combination of the chart of FIG. 6 and the chart of FIG. 7.

Although particular types of flow patterns 80 and 92 is discussed hereinabove, the surface nozzle 60 can work equally well with a variety of different types of mixing systems that generate differing flow patterns. Several different types of flow patterns may develop, depending upon the orientation and positioning of the mixing nozzles 30, resulting in differing flows on the surface of the tank contents 70 which effect the position of the generally circular band 78. For example, the balance of inward forces due to fluid contacting the outer surrounding wall 22 may be lessened in a generally rotational flow field with the circumferential forces 90 shifting the location of the generally circular band 78 closer to the outer surrounding wall 22. The upper nozzle 60 can also be used in square or rectangular tanks when generally predeterminable flow paths for solid debris pieces are present.

EXAMPLE 1

The following example illustrates the tank mixing system in accordance with the above description as applied in a system having the following dimensional parameters, and similar to the tank mixing system 10 of FIGS. 1 and 2:

| | |
|---|---|
| Tank Diameter | 100 feet |
| Tank Depth | 37.5 feet |
| Cone Depth | 10 feet |
| Tank Volume | 2,400,000 gallons |
| Submerged Nozzles | 3 inner and 3 outer |
| Submerged Nozzle Radius | 20 feet and 40 feet |

The nozzles 30 are positioned on the floor 24 of the tank 20 in two concentric rings, an inner ring having a radius of 20 feet and an outer ring having a radius of 40 feet. Each ring has three nozzles 30 disposed about its circumference for a total of six nozzles in the tank 20. The tank diameter is about 100 feet, and the tank depth is about 37.5 feet along the sidewall and 47.5 feet in the center of the tank 20 due to a conically shaped tank floor 24. Given these dimensions, the total volume of the tank is about 2,400,000 gallons.

A 120 horsepower motor running at 1050 rpm was used to pump 5200 gallons per minute of fluid 35 through the six mixing nozzles 60 positioned on the floor 24 of the tank 20. Using the above equations, the energy gradient in the tank 20 is about 50 HP/1,000,000 gallons. Using the chart of FIG. 7 for approximately determining the position of the generally circular band 78, the tank of EXAMPLE 1, having a diameter of 100 feet and an energy gradient of about 50 HP/1,000,000 gallons will have a generally circular band 78 located between about 8 feet to 10 feet inward from the outer surrounding wall 22 of the tank 20.

The surface nozzle 60, disposed about 10 feet above the surface level of the tank contents, is aimed to discharge a stream of fluid 65 downward to within the generally circular band 78 and tangent thereto. The fluid flow rate for the upper nozzle 60 is selected to between about 500 gallons per minute. These parameters for the upper nozzle 60 are summarized in the below table:

| | |
|---|---|
| Energy Gradient | 50 HP/MG |
| Circular Band Position | 8 feet to 10 feet |
| Surface Nozzle Angle to Surface | 20 degrees |
| Surface Nozzle Elevation | 10 feet |
| Surface Nozzle Angle to Radius | 37 degrees |
| Surface Nozzle Pump Rate | 500 gpm |

EXAMPLE 2

The following example illustrates the tank mixing system in accordance with the above description as applied in a system having the following dimensional parameters:

| | |
|---|---|
| Tank Diameter | 60 feet |
| Tank Depth | 21.5 feet |
| Cone Depth | 13 feet |
| Tank Volume | 600,000 gallons |
| Submerged Nozzles | 2 |
| Submerged Nozzle Radius | 12 feet |

The nozzles 30 are positioned on the floor 24 of the tank 20 in a ring having a radius of 12 feet. The ring has three nozzles 30 disposed about its circumference. The tank diameter is about 60 feet, and the tank depth is about 21.5 feet along the sidewall and 33.5 feet in the center of the tank 20 due to a conically shaped tank floor 24. Given these dimensions, the total volume of the tank is about 600,000 gallons.

A 40 horsepower motor running at 1450 rpm was used to pump 1200 gallons per minute of fluid 35 through the three mixing nozzles 60 positioned on the floor 24 of the tank 20. Using the above equations, the energy gradient in the tank 20 is about 65 HP/1,000,000 gallons. Using the chart of FIG. 6 for approximately determining the position of the generally circular band 78, the tank of EXAMPLE 1, having a diameter of 60 feet and an energy gradient of about 65 HP/1,000,000 gallons will have a generally circular band 78 located approximately between about 6 feet to 9 feet inward from the outer surrounding wall 22 of the tank 22. The location of the generally circular band 78 was estimated based upon the approximate positions of generally circular bands 78 for 100 foot diameter tanks and 30 foot diameter tanks.

The location of the generally circular band 78 can be adjusted using the chart of FIG. 7 due the viscosity of the tank contents. The fluid contents 70 of the tank 20 have a larger than normal viscosity, with a solid content 74 working range of between two and five percent of the total volume 70, and an average range of between 3.5% and 4.5% of the total volume 70. Temperature range is between about 30 C and 35 C. Assuming that this will result in a tank viscosity of about 60000 centipoise, the location of the generally circular band 78 can vary by about ten percent, for a generally circular band 78 extending between about 6.5 feet and about 10 feet inward of the tank outer surrounding wall 22.

The preferred surface nozzle 60, disposed about 10 feet above the surface level of the tank contents, is aimed to discharge a stream of fluid 65 downward to within the generally circular band 78 and tangent thereto. The fluid flow rate for the upper nozzle 60 is selected to between about 200 gallons per minute (representing about 1/30 of a percent of the contents volume) and about 500 gallons per minute (representing an upper limit on the nozzle discharge). These parameters for the upper nozzle 60 are summarized in the below table:

| | |
|---|---|
| Energy Gradient | 65 HP/MG |
| Circular Band Position | 8 feet to 10 feet |
| Surface Nozzle Angle to Surface | 25 degrees |
| Surface Nozzle Elevation | 10 feet |
| Surface Nozzle Angle to Radius | 50 degrees |
| Surface Nozzle Pump Radius | 200 gpm to 500 gpm |

As can be appreciated from the above description of FIGS. 1–7 and the above examples, there is provided a new improved method and apparatus for mixing the liquid and solid components 74 and 76 of the contents 70 of a tank 20 using a tank mixing system 10. A nozzle 60 can be prepositioned to discharge a stream of fluid 65 toward the surface of the tank contents 70 to break up solid debris 72 present at or near the surface in a predeterminable generally circular band 78, which provides the improved result of breaking apart or otherwise mixing the solid, debris 72 present at or near the surface of the tank contents 70 for the purpose of urging the solid debris 72 into the flow patterns 80 and 92 present within the tank for facilitating mixing of the tank contents 70. While there have been illustrated and described particular embodiments, it will be appreciated that numerous changes and modifications will occur to those skilled in the art, and it is intended in the appended claims to cover all those changes and modifications which fall within the true spirit and scope thereof.

What is claimed is:

1. A system for mixing liquid and solid components of contents of a tank, the system comprising:

a generally circular tank with an outer surrounding wall having a radius at least partially filled with the contents having a surface to a liquid level;

a sump for withdrawing at least some of the contents from the tank;

a pump having an input operatively connected to the sump for withdrawing the at least some of the contents of the tank from the sump;

at least one submerged flow generating device positioned within the tank and operatively connected to a discharge of the pump for pumping the at least some of the contents of the tank through the submerged nozzle to rotate the contents of the tank in a circumferential direction; and an upper flow generating device positioned at an elevation above the liquid level of the tank contents and aimed to selectively discharge at least some of the contents into the tank at a downward angle relative to the surface of the liquid contents and generally tangent to a generally circular band on the surface between the tank outer surrounding wall and a center of the tank.

2. The system for mixing liquid and solid contents of a tank in accordance with claim 1, wherein the radius of the generally circular band is between about 2% and 50% of the tank radius.

3. The system for mixing liquid and solid contents of a tank in accordance with claim 2, wherein the discharge from the at least one flow generating device causes an energy gradient within the tank and the radius of the generally circular band is between about 2% and 20% of the tank radius when the energy gradient is below 80 horsepower per million gallons.

4. The system for mixing liquid and solid contents of a tank in accordance with claim 2, wherein the discharge from the at least one flow generating device causes an energy gradient within the tank and the radius of the generally circular band is between about 20% and 50% of the tank radius when the energy gradient is above 80 horsepower per million gallons.

5. The system for mixing liquid and solid contents of a tank in accordance with claim 1, wherein the upper flow generating device is a discharge nozzle and the at least one flow generating device is a discharge nozzle.

6. The system for mixing liquid and solid contents of a tank in accordance with claim 1, wherein the upper flow generating device is operatively connected to the pump that withdraws at least some of the contents from the tank through the sump for discharge through the upper flow generating device.

7. The system for mixing liquid and solid contents of a tank in accordance with claim 6, wherein the upper flow generating device has a discharge rate of between about 100 gallons per minute and 500 gallons per minute.

8. The system for mixing liquid and solid contents of a tank in accordance with claim 6, wherein the tank contents have a volume and the discharge rate of the upper flow generating device is selected to be between about 1/10 percent and 1/30 percent of the contents volume.

9. A system for mixing the liquid and solid contents of a tank, the system comprising:

an outer wall of the tank at least partially containing the contents, the contents having a surface;

at least one flow generating device discharging fluid into the tank, the fluid discharge creating a fluid flow within the tank having a flow moving the tank contents in a direction of rotation along with a generally inward component and a generally outward component proximate the surface of the tank contents, the generally inward and outward components of the fluid flow meeting in a region of the tank; and a surface flow generating device directing a fluid stream onto the surface generally at the region of the tank where the generally inward and outward components of the fluid flow meet.

10. The system in accordance with claim 9, wherein the tank has a floor and is generally circular, the outer wall surrounding the tank at a radial position from a center of the tank, the surface of the tank contents extending to a height above the floor, and the at least one flow generating device is a discharge nozzle submerged beneath the surface of the tank contents.

11. The system in accordance with claim 10, wherein the surface flow generating device is a discharge nozzle positioned a distance spaced above the surface of the contents.

12. The system in accordance with claim 11, wherein a pump having a pumping rate is operatively connected between the tank and the at least one flow generating nozzle for drawing at least some of the contents of the tank and discharging them through the at least one flow generating nozzle to create the fluid flow.

13. The system in accordance with claim 12, wherein the region of the tank where the generally inward and outward components of the fluid flow meet is a generally circular band disposed between the outer wall and a center of the tank at a position generally predeterminable based upon the energy gradient in the tank, the viscosity of the tank contents, and the tank radius.

14. A system in accordance with claim 13, wherein a portion of the solid contents is present on the surface of the tank contents in the generally circular band where the generally inward and outward components of the fluid flow meet and the surface nozzle is positioned to discharge the fluid stream to contact the portion of the solid contents.

15. A system in accordance with claim 14, wherein the contact between fluid stream and the portion of the solid contents breaks up the portion of the solid contents for submergence beneath the surface of the tank contents.

16. A system in accordance with claim 14, wherein the fluid stream of the surface nozzle is positioned at an angle relative to a radial line extending from the tank center to the tank outer wall and in the direction of rotation of the tank contents.

17. A system in accordance with claim 16, wherein the fluid flow includes a flow toward the outer portion of the tank in the lower portion of the tank, upward in the outer portion of the tank, inward in the upper portion of the tank, and downward in the inner portion of the tank.

18. A method for mixing the liquid and solid contents of a tank having an outer surrounding wall, the method comprising:

discharging a stream of fluid into the tank through one or more discharge nozzles;

creating a fluid flow within the tank using the fluid discharged through the one or more submerged nozzles at a fluid discharge rate, the fluid flow having a generally inward component and a generally outward component near a surface of the tank contents, the generally inward and outward components of the fluid flow generally meeting in a generally circular band of the tank contents; and directing a fluid flow from a surface nozzle onto the surface at the radial band of the tank contents where the generally inward and outward components of the fluid flow meet.

19. The method of claim 18, including determining the location of the region of the tank where the generally inward and outward components of the fluid flow generally meet based upon the tank size, the contents characteristics, and the fluid discharge rate.

20. The method of claim 18, wherein the step of creating a fluid flow includes inducing a rotational flow of the tank contents with the one or more discharge nozzles and the step of directing a fluid flow includes aiming the surface nozzle in the direction of rotation of the tank contents.

* * * * *